US010032405B2

(12) United States Patent
Jeong et al.

(10) Patent No.: US 10,032,405 B2
(45) Date of Patent: Jul. 24, 2018

(54) ORGANIC LIGHT-EMITTING DISPLAY AND METHOD FOR DRIVING THE SAME

(71) Applicant: LG DISPLAY CO., LTD., Seoul (KR)

(72) Inventors: Jaehyeong Jeong, Paju-si (KR); Seonggyun Kim, Gunpo-si (KR)

(73) Assignee: LG DISPLAY CO., LTD., Seoul (KR)

( * ) Notice: Subject to any disclaimer, the term of this patent is extended or adjusted under 35 U.S.C. 154(b) by 393 days.

(21) Appl. No.: 14/983,224

(22) Filed: Dec. 29, 2015

(65) Prior Publication Data

US 2017/0098407 A1 Apr. 6, 2017

(30) Foreign Application Priority Data

Oct. 2, 2015 (KR) ..... 10-2015-0139384

(51) Int. Cl.

| | |
|---|---|
| ***G09G 3/20*** | (2006.01) |
| ***G09G 3/3233*** | (2016.01) |
| ***G09G 3/3258*** | (2016.01) |
| ***G09G 3/3275*** | (2016.01) |

(52) U.S. Cl.

CPC ..... *G09G 3/2051* (2013.01); *G09G 3/3233* (2013.01); *G09G 3/3258* (2013.01); *G09G 3/3275* (2013.01); *G09G 2300/0819* (2013.01); *G09G 2300/0842* (2013.01); *G09G 2310/027* (2013.01); *G09G 2310/0251* (2013.01); *G09G 2310/0286* (2013.01); *G09G 2310/08* (2013.01); *G09G 2320/0233* (2013.01); *G09G 2320/0238* (2013.01); *G09G 2320/0276* (2013.01); *G09G 2320/0295* (2013.01); *G09G 2320/043* (2013.01); *G09G 2320/0693* (2013.01); *G09G 2360/16* (2013.01)

(58) Field of Classification Search

CPC ... G09G 3/2051; G09G 3/3275; G09G 3/3233
See application file for complete search history.

(56) References Cited

U.S. PATENT DOCUMENTS

| | | | | |
|---|---|---|---|---|
| 2004/0108998 | A1* | 6/2004 | Imamura | G09G 3/3283 345/204 |
| 2005/0110728 | A1* | 5/2005 | Cok | G09G 3/3216 345/82 |
| 2006/0071886 | A1* | 4/2006 | Johnson | G09G 3/3216 345/77 |
| 2008/0165212 | A1* | 7/2008 | Morita | G09G 3/3648 345/690 |

* cited by examiner

*Primary Examiner* — Alexander Eisen
*Assistant Examiner* — Mansour M Said
(74) *Attorney, Agent, or Firm* — Birch, Stewart, Kolasch & Birch, LLP

(57) ABSTRACT

An organic light-emitting display device and a method for driving the same are provided. The organic light-emitting display device analyzes input image data in unit of a window mask to detect a halftone data block, adjusts a voltage corresponding to grayscale 0 of center data disposed at the center of the halftone data block to a voltage higher than 0V, and adjusts the voltage corresponding to grayscale 0 in a data block other than the halftone data block to 0V, such that a data voltage swing width at low grayscales can be reduced so as to prevent voltage drop in pixels, thereby improving picture quality.

19 Claims, 16 Drawing Sheets

FIG. 7

0.5 gray =

| | | | | | | | | |
|---|---|---|---|---|---|---|---|---|
| 0 | 1 | 0 | 1 | 0 | 1 | 0 | 1 | L1 |
| 1 | 0 | 1 | 0 | 1 | 0 | 1 | 0 | L2 |
| 0 | 1 | 0 | 1 | 0 | 1 | 0 | 1 | L3 |
| 1 | 0 | 1 | 0 | 1 | 0 | 1 | 0 | L4 |

FIG. 8

1.5 gray =

| | | | | | | | | |
|---|---|---|---|---|---|---|---|---|
| 1 | 2 | 1 | 2 | 1 | 2 | 1 | 2 | L1 |
| 2 | 1 | 2 | 1 | 2 | 1 | 2 | 1 | L2 |
| 1 | 2 | 1 | 2 | 1 | 2 | 1 | 2 | L3 |
| 2 | 1 | 2 | 1 | 2 | 1 | 2 | 1 | L4 |

< 0G - 1G dithering >

< 1G - 2G dithering >

FIG. 12

| | | | | | | | | |
|---|---|---|---|---|---|---|---|---|
| D11 | D12 | D13 | D14 | D15 | D16 | D17 | D18 | D19 |
| D21 | D22 | D23 | D24 | D25 | D26 | D27 | D28 | D29 |
| D31 | D32 | D33 | D34 | D35 (0) | D36 | D37 | D38 | D39 |
| D41 | D42 | D43 | D44 | D45 | D46 | D47 | D48 | D49 |
| D51 | D52 | D53 | D54 | D55 | D56 | D57 | D58 | D59 |

0 gray =

| | | | | | | | | |
|---|---|---|---|---|---|---|---|---|
| 0 | 0 | 0 | 0 | 0 | 0 | 0 | 0 | L1 |
| 0 | 0 | 0 | 0 | 0 | 0 | 0 | 0 | L2 |
| 0 | 0 | 0 | 0 | 0 | 0 | 0 | 0 | L3 |
| 0 | 0 | 0 | 0 | 0 | 0 | 0 | 0 | L4 |

< Entire black image >

0.5 gray =

| | | | | | | | | |
|---|---|---|---|---|---|---|---|---|
| 0 | 1 | 0 | 1 | 0 | 1 | 0 | 1 | L1 |
| 1 | 0 | 1 | 0 | 1 | 0 | 1 | 0 | L2 |
| 0 | 1 | 0 | 1 | 0 | 1 | 0 | 1 | L3 |
| 1 | 0 | 1 | 0 | 1 | 0 | 1 | 0 | L4 |

< 0 gray - 1 gray dithering >

1.5 gray =

| | | | | | | | | |
|---|---|---|---|---|---|---|---|---|
| 1 | 2 | 1 | 2 | 1 | 2 | 1 | 2 | L1 |
| 2 | 1 | 2 | 1 | 2 | 1 | 2 | 1 | L2 |
| 1 | 2 | 1 | 2 | 1 | 2 | 1 | 2 | L3 |
| 2 | 1 | 2 | 1 | 2 | 1 | 2 | 1 | L4 |

< 1 gray - 2 gray dithering >

ORGANIC LIGHT-EMITTING DISPLAY AND METHOD FOR DRIVING THE SAME

This application claims priority from the benefit under 35 U.S.C. § 119(a) of Korean Patent Application No. 10-2015-0139384 filed on Oct. 2, 2015, entire contents of which are incorporated herein by reference for all purposes as if fully set forth herein.

BACKGROUND OF THE INVENTION

Field of the Invention

The present invention relates to an organic light-emitting display device for improving expression of low grayscales.

Discussion of the Related Art

Active matrix type organic light-emitting display devices include an organic light-emitting diode (referred to as "OLED" hereinafter) and have advantages of high response speed, high emission efficiency, high luminance and wide viewing angle. The OLED includes an organic compound layer formed between an anode and a cathode. The organic compound layer is composed of a hole injection layer (HIL), a hole transport layer (HTL), an emission layer (EML), an electron transport layer (ETL) and an electron injection layer (EIL). When driving voltages are applied to the anode and the cathode, holes that have passed through the HTL and electrons that have passed through the ETL move to the EML and generate excitons, resulting in generation of visible light from the EML.

Each pixel of an organic light-emitting display device includes a driving element which controls current flowing through an OLED. The driving element may be implemented as a thin film transistor (TFT). It is desirable that electrical characteristics of the driving element, such as threshold voltage and mobility, be equal across all pixels. However, electrical characteristics of driving TFTs of pixels are not uniform due to processing conditions, driving environment and the like. The driving element suffers from higher stress as driving time increases and the stress depends on a data voltage. The electrical characteristics of the driving element are affected by stress applied to the driving element. Accordingly, electrical characteristics of driving TFTs vary with time.

Methods for compensating for driving characteristic variation of a pixel in the organic light-emitting display device are divided into an internal compensation method and an external compensation method.

The internal compensation method automatically compensates for a threshold voltage variation in driving TFTs inside of pixel circuits. For internal compensation, current flowing through OLED needs to be determined irrespective of a threshold voltage of a corresponding driving TFT and thus a pixel circuit configuration becomes complicated. In addition, the internal compensation method has difficulty in compensating for mobility variation in driving TFTs.

The external compensation method compensates for a driving characteristic variation of each pixel by sensing electrical characteristics (threshold voltage, mobility and the like) of driving TFTs and modulating pixel data of an input image on the basis of the sensing result in a compensation circuit outside a display panel.

An external compensation circuit directly receives a sensing voltage from each pixel of the display panel through an REF line (or sensing line) connected to the pixel, converts the sensing voltage into digital sensing data to generate a sensing value and transmits the sensing value to a timing controller. The timing controller modulates digital video data of an input image on the basis of the sensing value to compensate for driving characteristic variation of the pixel.

To express a larger number of grayscales in a display device, a grayscale expansion method such as spatial dithering and frame rate control (FRC) can be applied. Such a grayscale expansion method can express higher-bit grayscale using a low-bit data driving circuit so as to achieve inexpensive display devices. Dithering can represent a larger number of grayscales than the number of bits of pixel data by dispersing decimal grayscale values below 1 to neighboring pixels. FRC disperses decimal grayscale values below 1 in the time domain to expand the number of grayscales. Dithering and FRC can be applied together.

When a grayscale expansion method is applied to the organic light-emitting display device, picture quality may be degraded such that grayscale representation is deteriorated or luminance is decreased.

SUMMARY OF THE INVENTION

The present invention provides an organic light-emitting display device capable of improving picture quality and a method for driving the same.

An organic light-emitting display device according to the present invention analyzes input image data in units of a window mask to detect a halftone data block, adjusts a voltage corresponding to grayscale 0 of center data disposed at the center of the halftone data block to a voltage higher than 0V and adjusts the voltage corresponding to grayscale 0 in a data block other than the halftone data block to 0V.

The halftone data block is a data block in which center data of the window mask has grayscale 0 and the number of grayscales higher than 0 exceeds a predetermined threshold value in neighbor data of the center data.

A pixel of the organic light-emitting display device includes a driving element. A reference voltage higher than 0V is supplied to a source of the driving element, and the voltage corresponding to grayscale 0 is supplied to a gate of the driving element.

A method for driving the organic light-emitting display device includes: analyzing input image data in units of a window mask to detect a halftone data block; adjusting a voltage corresponding to grayscale 0 of center data disposed at the center of the halftone data block to a voltage higher than 0V; and adjusting the voltage corresponding to grayscale 0 in a data block other than the halftone data block to 0V.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 7 illustrates an exemplary method of representing grayscale 0.5 through a dithering method;

FIG. 8 illustrates an exemplary method of representing grayscale 1.5 through the dithering method;

FIG. 12 illustrates an exemplary window defining a data block size;

DETAILED DESCRIPTION OF THE EMBODIMENTS

Preferred embodiments of the present invention will be described in detail with reference to the attached drawings. The same reference numbers will be used throughout this specification to refer to the same or like parts. In the following description of the present invention, a detailed description of known functions and configurations incorporated herein will be omitted when it may obscure the subject matter of the present invention.

Figure 1:
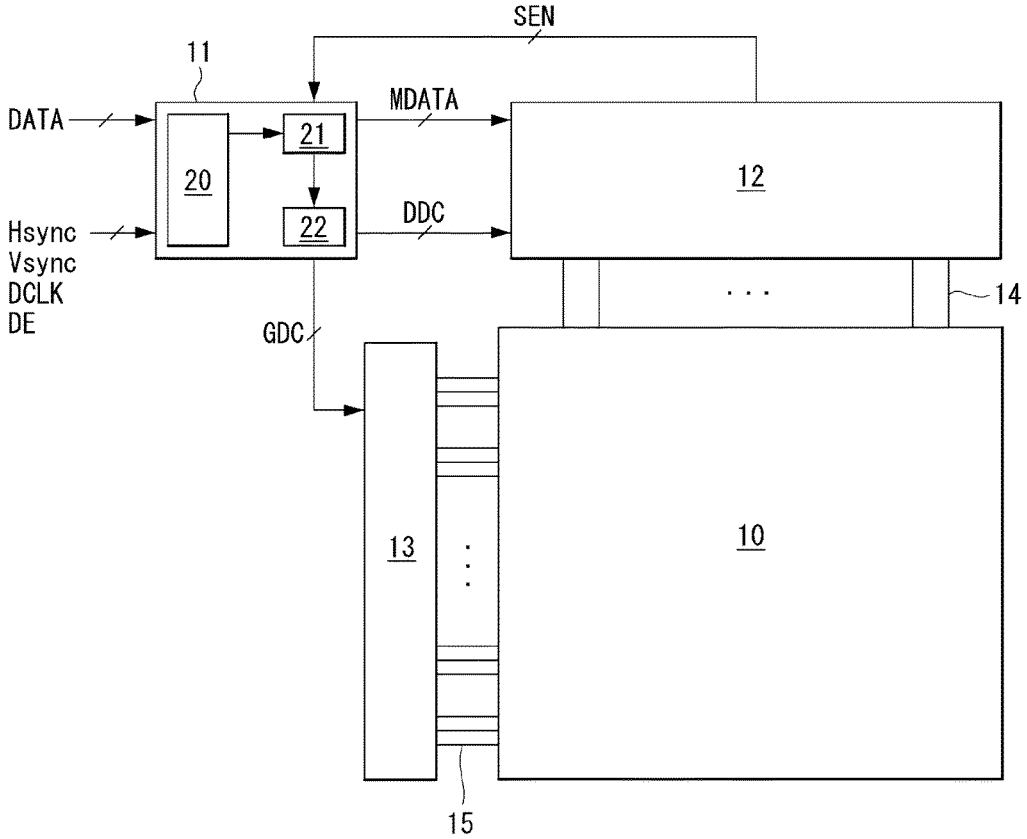
FIG. 1 is a block diagram of an organic light-emitting display device according to an embodiment of the present invention.
Figure 2:
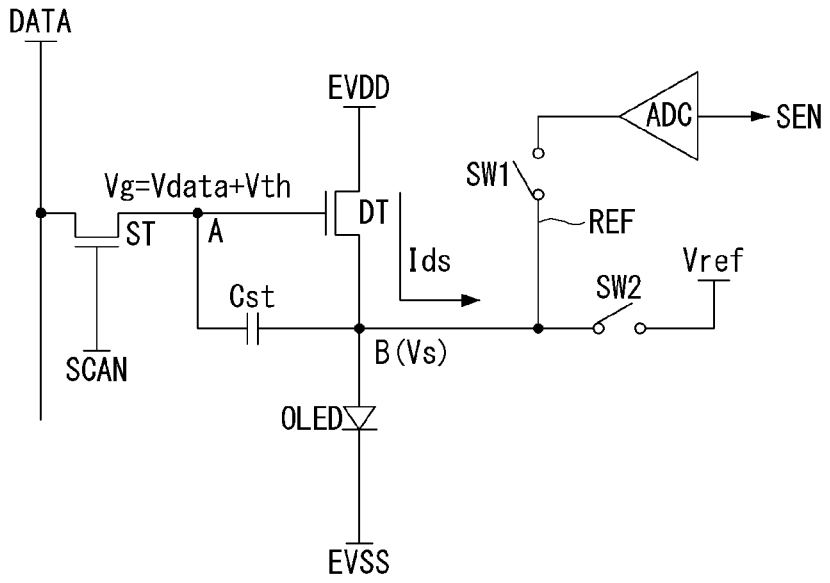
FIG. 2 is an equivalent circuit diagram of a pixel shown in FIG. 1.
Figure 3:
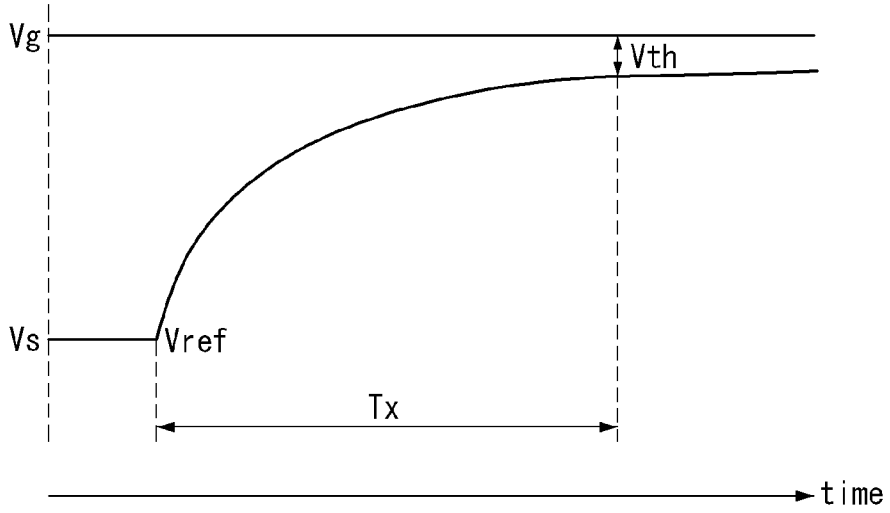
FIG. 3 is a waveform diagram showing a method for sensing a threshold voltage of a driving TFT shown in FIG. 2.

FIG. 1 is a block diagram of an organic light-emitting display device according to an embodiment of the present invention, FIG. 2 is an equivalent circuit diagram of a pixel shown in FIG. 1 and FIG. 3 is a waveform diagram showing a method for sensing a threshold voltage of a driving TFT shown in FIG. 2.

Referring to FIGS. 1 and 2, the organic light-emitting display device according to an embodiment of the present invention includes a display panel 10, a data driver 12, a gate driver 13 and a timing controller 11.

The display panel 10 includes a plurality of data lines 14, a plurality of gate lines 15 intersecting the data lines 14, and pixels arranged in a matrix form. A pixel array of the display panel 10 displays data of an input image. The display panel 10 includes a reference voltage line (referred to as "REF line" hereinafter) and an EVDD line through which a high driving voltage EVDD is supplied to the pixels. A reference voltage Vref from a reference voltage source is supplied to the pixels through the REF line. A driving characteristic variation in a pixel is sensed through the REF line REF for a sensing period, and a predetermined reference voltage Vref is supplied to the pixels through the REF line REF for a normal drive period. The reference voltage Vref may be set to higher than 0, for example, 2V. However, the reference voltage is not limited thereto. The reference voltage Vref may depend on the resolution, driving method and the like of the display device.

Pixels are classified into red, green and blue sub-pixels for color expression. The pixels may further include a white sub-pixel. In the following description, a pixel refers to a sub-pixel. Interconnection lines such as one data line, the REF line and the EVDD line are coupled to each pixel.

The data driver 12 supplies a data voltage for sensing to the pixels for a predetermined sensing period under the control of the timing controller 11. The sensing period may be assigned to a blank period in which input image data is not received between frame periods, that is, a vertical blank period. The sensing period may include a predetermined period immediately after the display device is powered on or immediately after the display device is powered off. The data voltage for sensing is applied to a gate of a driving TFT of each pixel for the sensing period. The data voltage for sensing turns on the driving TFT for the sensing period such that current flows through the driving TFT. The data voltage SDATA for sensing is generated as a voltage corresponding to a predetermined grayscale. The data voltage SDATA for sensing may be varied according to sensed grayscale.

The timing controller 11 transmits sensing data prestored in an embedded memory to the data driver 12 for the sensing period. The sensing data is preset irrespective of input image data to sense driving characteristics of pixels. The data driver 12 converts the sensing data received as digital data into a gamma compensation voltage through a digital-to-analog converter (referred to as a "DAC" hereinafter) so as to output the data voltage for sensing. The data driver 12 transmits, to the timing controller, a sensing value SEN obtained by receiving, as digital data, a sensing voltage generated from current flowing through a pixel when the data voltage for sensing is supplied to the pixel, through a sensing path. The sensing voltage is proportional to pixel current. The sensing path includes the REF line REF, an analog-to-digital converter (referred to as "ADC" hereinafter) which converts the sensing voltage into digital data, and a sample & holder which is not shown. First and second switch elements SW1 and SW2 may be connected to the sensing path. The first switch element SW1 may be switched on for the sensing period so as to connect the ADC to the corresponding pixel and switched off for the normal driving period so as to block a current path between the ADC and the pixel. The second switch element SW2 may be switched off for the sensing period and switched on for the normal driving period such that the reference voltage Vref is supplied to the pixel. The sample & holder may be configured in the form of a capacitor coupled to the first switch element SW1 and the REF line REF. The sample & holder samples the sensing voltage by storing the sensing voltage in the capacitor and supplies the sampled sensing voltage to the ADC.

The data driver 12 converts digital video data MDATA of the input image, received from the timing controller 11, to a gamma compensation voltage using the DAC to generate a data voltage for the normal driving period in which the input image is displayed. The data voltage is supplied to the pixels through the data lines 14. The digital video data MDATA supplied to the data driver 12 is data MDATA that has been modulated by the timing controller 11. For the normal driving period, a predetermined reference voltage is supplied to the pixels through the REF line REF. Circuit elements connected to the sensing path may be integrated with the data driver 12 in an integrated circuit (IC) chip.

The range of the data voltage output from the data driver 12 is extended by a compensation voltage margin, as described later. The compensation voltage margin may be secured by a voltage applied to the source of the driving TFT, for example, the reference voltage Vref.

The gate driver 13 generates a scan pulse SCAN and supplies the scan pulse SCAN to the gate lines 15. The scan pulse SCAN is supplied to a switching TFT (ST) shown in FIG. 2. The gate driver 13 can sequentially supply the scan pulse SCAN to the gate lines 15 by shifting the scan pulse using a shift register. The shift register of the gate driver 13 may be directly formed on the substrate of the display panel 10 along with the pixel array through a GIP (Gate-driver In Panel) process.

The timing controller 11 receives digital video data DATA of an input image and timing signals synchronized with the digital video data DATA from a host system. The timing signals include a vertical synchronization signal Vsync, a horizontal synchronization signal Hsync, a clock signal DCLK and a data enable signal DE. The host system may be one of a TV system, a set-top box, a navigation system, a DVD player, a Blu-ray player, a personal computer, a home theater system and a phone system.

The timing controller 11 may generate a data timing control signal DDC for controlling operation timing of the data driver 12, a gate timing control signal GDC for controlling operation timing of the gate driver 13, and a switch control signal for controlling operation timing of the first and second switch elements SW1 and SW2 on the basis of the timing signals received from the host system.

The timing controller 11 includes a data modulation module for modulating the digital video data of the input image in order to improve low grayscale expression and to compensate for driving characteristic variation of pixels. The data modulation module of the timing controller 11 includes a first data compensation unit 21 and a second data compensation unit 22. The data modulation module analyzes input image data in units of a window mask having a predetermined size to detect a half tone data block, adjusts a voltage corresponding to grayscale 0 of data disposed at the center of the half tone data block to higher than 0V, and adjusts the voltage corresponding to grayscale 0 in a data block other than the half tone data block to 0V. In addition, the data modulation module compensates for driving characteristic variation of pixels on the basis of a sensing value SEN using an external compensation method.

The first data compensation unit 21 detects a data block (referred to as "halftone data block" hereinafter) including a minimum grayscale and a higher grayscale from a window region having a predetermined size. The first data compensation unit 21 may analyze data in units of an m×n (m and n represent the number of pixels and are positive integers equal to or greater than 2) window. The m×n window defines the size of a data block. A data block having grayscale 0 (referred to as "0G" hereinafter) includes not only a data block having a minimum grayscale and a higher grayscale in input image data but also a data block in which a dither compensation value (third compensation value) is spatially distributed in order to represent decimal grayscales less than grayscale 1 (referred to as "1G" hereinafter) through dithering.

The first data compensation unit 21 increases a minimum grayscale voltage by adding a predetermined first compensation value to data corresponding to the minimum grayscale in order to adjust a data voltage corresponding to the minimum grayscale included in the halftone data block to a minimum voltage. The minimum grayscale may be 0G and the minimum voltage may be 0V. The first compensation value is a digital data value. The first compensation value is set to a digital data value generating a voltage corresponding to minimum pixel luminance in a compensation voltage margin which will be described later. Here, the minimum pixel luminance refers to luminance which is measured as 0 nit and represents black grayscale. The first compensation value can be set to a digital value of a highest voltage which can drive pixels in minimum luminance (0 nit) within the compensation voltage margin. The first compensation value may be varied according to the number of grayscales higher than the minimum grayscale in the halftone data block.

When a data block (referred to as "black data block" hereinafter) in which most data corresponds to the minimum grayscale is detected from a window having a predetermined size, the first data compensation unit 21 maintains the voltage corresponding to the minimum grayscale included in the black data block as a minimum data voltage. To this end, the first data compensation unit 21 transmits all data of the black data block to the second data compensation unit 22.

The second data compensation unit 22 selects a second compensation value for compensating for drive characteristic variations of pixels on the basis of sensing values SEN received from the pixels. The second compensation value may be preset in consideration of drive characteristic variations in pixels and stored in a memory of a look-up table (LUT). The second compensation value can be applied through a known external compensation method and detailed description thereof is thus omitted. The second data compensation unit 22 modulates input image data to be written to pixels with the second compensation value. The second compensation value includes an offset value for compensating for threshold voltage variation of the driving TFT and a gain value for compensating for mobility variation of the driving TFT. The offset value compensates for threshold voltage variation of the driving TFT by being added to the digital video data DATA of the input image. The gain value compensates for mobility variation of the driving TFT by being multiplied by the digital video data DATA of the input image.

The timing controller 11 may implement a grayscale expansion method which adds the third compensation value to the input image data in order to represent decimal grayscales below 1. To this end, the timing controller 11 may include a dithering unit 20. The dithering unit 20 adds the third compensation value to the input image data so as to spatially disperse the third compensation value to neighbor pixels, thereby representing decimal grayscales below 1. The dithering unit 20 can simultaneously apply dithering and FRC by temporally dispersing the third compensation value.

Each pixel includes an OLED, a driving TFT DT, a switching TFT ST and a storage capacitor Cst. It is noted that a pixel circuit is not limited to FIG. 2.

The OLED includes an organic compound layer formed between an anode and a cathode. The organic compound layer may include a hole injection layer (HIL), a hole transfer layer (HTL), an emission layer (EML), an electron transfer layer (ETL) and an electron injection layer (EIL). However, the organic compound layer is not limited thereto.

While the switching TFT ST and the driving TFT DT are implemented as n-type metal oxide semiconductor field effect transistors (MOSFETs) in FIG. 2, the TFTs may be implemented as p-type MOSFETs. The TFTs may be implemented as one of an amorphous silicon (a-Si) TFT, a polysilicon TFT and an oxide semiconductor TFT or a combination thereof.

The anode of the OLED is coupled to the driving TFT DT via a second node B. The cathode of the OLED is coupled to a low voltage source and provided with a low voltage EVSS.

The driving TFT DT controls current flowing through the OLED according to a gate-source voltage Vgs thereof. The driving TFT DT includes a gate coupled to a first node A, a drain provided with a high-level driving voltage EVDD and a source coupled to the second node B. The storage capacitor Cst is coupled between the first node A and the second node B to maintain the gate-source voltage Vgs of the driving TFT DT.

The switching TFT ST supplies a data voltage Vdata from the data line 14 to the first node A in response to the scan pulse SCAN. The switching TFT ST includes a gate provided with the scan pulse SCAN, a source coupled to the data line 14 and a drain coupled to the first node A.

The threshold voltage of the driving TFT DT can be compensated through an external compensation method. The external compensation method senses the threshold voltage Vth of the driving TFT DT by operating the driving TFT as a source follower. This method determines the threshold voltage of the driving TFT on the basis of a sensing voltage applied to an ADC. To sense the threshold voltage Vth of the driving TFT DT, a data voltage Vdata higher than the threshold voltage Vth is applied to the gate of the driving TFT DT and a reference voltage Vref is applied to the source of the driving TFT DT. When the gate-source voltage Vgs of the driving TFT DT is higher than the threshold voltage Vth, the driving TFT is turned on. Here, drain-source current Ids of the driving TFT DT depend on the gate-source voltage Vgs of the driving TFT DT. The drain-source current Ids of the driving TFT DT increases due to the high-level driving voltage EVDD so as to raise a source voltage Vs of the driving TFT DT. Since the gate-source voltage Vgs of the driving TFT DT is high in the initial sensing period Tx in which the source voltage Vs of the driving TFT DT starts to increase, channel resistance of the driving TFT DT is low and thus the drain-source current Ids of the driving TFT DT increases. The gate-source voltage Vgs of the driving TFT DT decreases as the source voltage Vs of the driving TFT DT increases, and thus the channel resistance of the driving TFT DT increases and the drain-source current Ids of the driving TFT DT decreases. The gate-source voltage Vgs of the driving TFT DT when the source voltage Vs thereof is saturated is the threshold voltage Vth.

An external compensation method according to the present invention senses the threshold voltage Vth of the driving TFT DT and compensates for threshold voltage variation by modulating input image data. A negative or positive threshold voltage Vth can be negatively shifted with time. In consideration of this property, the external compensation method according to the present invention increases the source voltage Vs of the driving TFT DT by the reference voltage Vref by supplying the reference voltage Vref to the source of the driving TFT DT, thereby securing a compensation voltage margin. If the OLED represents a minimum grayscale (or black grayscale) when the threshold voltage Vth of the driving TFT DT is 2V and Vgs=0V and represents a maximum grayscale (or peak white grayscale) when Vgs=10V, when the source voltage Vs of the driving TFT DT is increased by Vref=2V, the data voltage Vdata increases by 2V. In this case, the gate voltage Vg is in the range of 0V to 2V, which is less than the threshold voltage of the driving TFT DT, can enable expression of the minimum grayscale and be used as a compensation voltage margin capable of compensating for the threshold voltage Vth of the driving TFT when the threshold voltage Vth is negative or negatively shifted. The minimum grayscale is 0G in FIG. 4.

Figure 4:
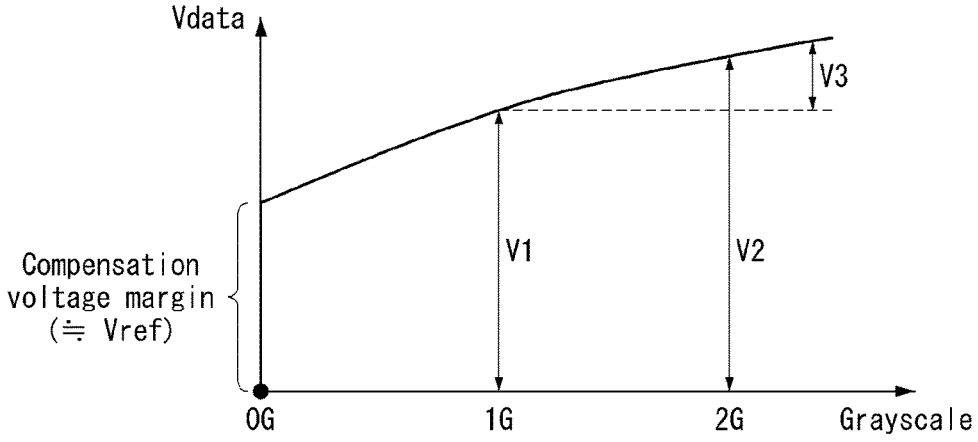
FIG. 4 illustrates an example of increasing a data voltage by a compensation voltage margin.

When the source voltage Vs of the driving TFT DT is increased by the reference voltage Vref, the data voltage Vdata increases. The data voltage Vdata corresponding to 0G can be set to Vdata=0V such that luminance of 0G is not increased in all pixels in consideration of Vth variations in pixels. In other words, while 0G can be represented in the range of Vdata from 0V to 2V, as shown in FIG. 4, the data voltage Vdata corresponding to 0G can be set to 0V when Vth variations are present in pixels. This method can prevent luminance of 0G from increasing in all pixels. However, the method increases a data voltage swing width between 0G and a higher grayscale. In the example of FIG. 4, V1 is a data voltage Vdata for representing 1G from 0G, V2 is a data voltage Vdata for representing grayscale 2 (referred to as "2G" hereinafter) from 0G, and V3 is a data voltage Vdata for representing 2G from 1G. As shown in FIG. 4, when the data voltage Vdata corresponding to 0G is set to 0V, data voltage swing widths V1 and V2 when the grayscale is changed from 0G to higher grayscales 1G and 2G become larger than that when the grayscale is changed from 1G to a higher grayscale 2G.

When the data voltage Vdata corresponding to 0G is set to 0V, a data voltage swing width increases in the halftone data block. When the data voltage swing width increases, pixel voltage drop due to RC delay of the display panel 10 increases and thus the data voltage Vdata charged in a pixel does not reach a target voltage. In RC delay, "R" indicates parasitic resistance of the display panel 10 and "C" indicates parasitic capacitance thereof.

Figure 5:
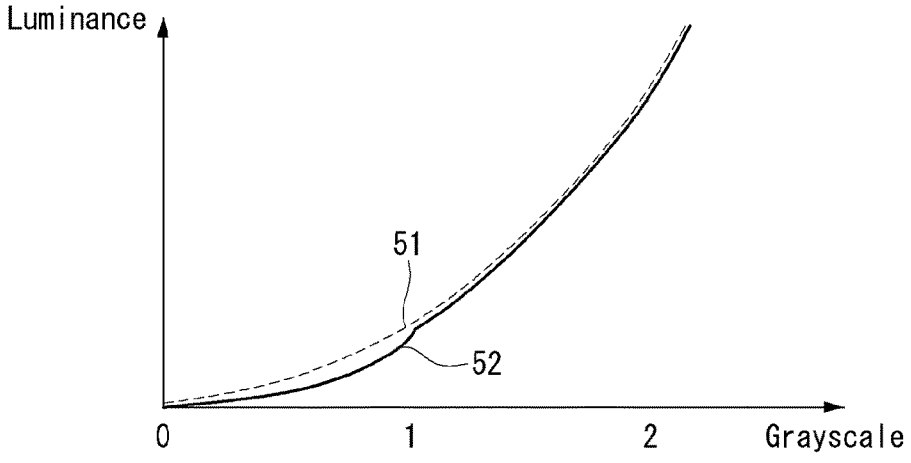
FIG. 5 illustrates an example in which luminance deterioration occurs at a low grayscale near grayscale 0 due to voltage drop in a pixel.

Since the data voltage swing width increases, voltage drop in pixels to which data of the halftone data block is written is larger than that in other data blocks. Accordingly, luminance decrease may occur at a low grayscale between 0G and 1G in the halftone data block, as shown in FIG. 5. In other words, when a compensation voltage margin is set in order to compensate for the threshold voltage Vth of the driving TFT DT and a minimum voltage is set to a data voltage corresponding to the minimum grayscale in the compensation voltage margin, gamma mismatching may occur at a low grayscale of the halftone data block, as shown in FIG. 5, resulting in grayscale expression deterioration. This phenomenon may occur in halftone data blocks in various forms. In FIG. 5, reference numeral "51" represents an ideal 2.2 gamma curve and "52" represents a gamma curve with decreased luminance in a low grayscale region.

Figure 6:
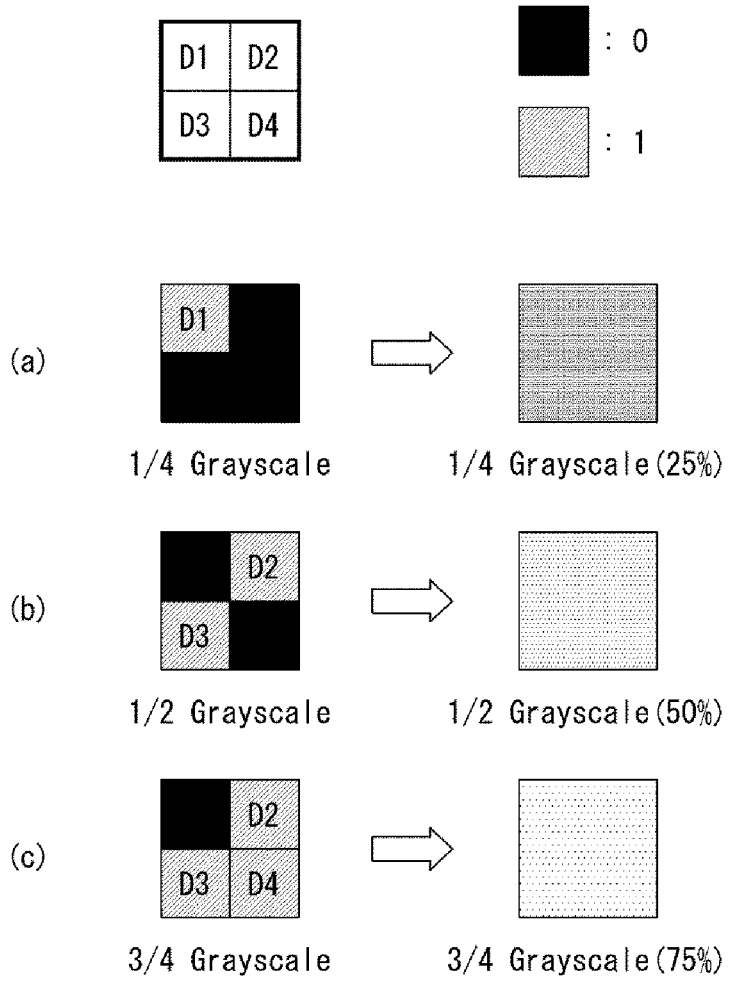
FIG. 6 illustrates an exemplary dithering method.

FIG. 6 illustrates an example of the dithering method of FIG. 6.

Referring to FIG. 6, the dithering method controls the number of pixels to which the third compensation value is added within a dither window mask having a predetermined size, which includes a plurality of pixels D1 to D4, to spatially disperse the third compensation value in order to finely adjust luminance to decimal grayscales below 1. Assuming the dither window mask including 2×2 pixels, as shown in FIG. 6(*a*), when the third compensation value "1" is written to one pixel D1 within the dither window mask, a viewer recognizes the average grayscale of the 2×2 pixels defined as the dither window mask as grayscale 0.25 (or ¼ grayscale (25%)). When the third compensation value "1" is written to two pixels D2 and D3 within the dither window mask, as shown in FIG. 6(*b*), the viewer recognizes the grayscale of the dither window mask as grayscale 0.5 (or ½ grayscale (50%)). When the third compensation value "1" is written to three pixels D2, D3 and D4 within the dither window mask, as shown in FIG. 6(*c*), the viewer recognizes the grayscale of the dither window mask as grayscale 0.75 (or ¾ grayscale (75%)). The dithering method is not limited to FIG. 6.

FIG. 7 illustrates an exemplary method of representing grayscale 0.5 through the dithering method. When the same number of 0G and 1G is spatially distributed, as shown in FIG. 7, luminance of a data block defined by a dither window mask is recognized as grayscale 0.5. FIG. 8 illustrates an exemplary method of representing grayscale 1.5 through the dithering method. When the same number of 0G and 2G is spatially distributed, as shown in FIG. 8, luminance of the data block is recognized as grayscale 1.5.

Figure 9:
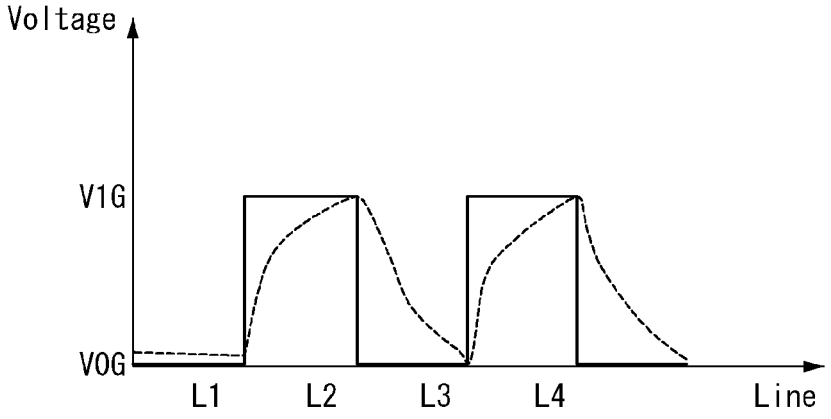
FIG. 9 is a graph showing a swing width of a data voltage when grayscale 0.5 as shown in FIG. 7 is expressed in an example in which a compensation voltage margin is secured and a data voltage corresponding to grayscale 0 is set to 0V.

FIG. 9 illustrates a data voltage swing width when grayscale 0.5 as shown in FIG. 7 is represented in an example in which a compensation voltage margin is secured and a data voltage corresponding to grayscale 0 is set to 0V. When the source voltage Vs of the driving TFT is increased by the reference voltage Vref in order to compensate for negative shift of the threshold voltage Vth of the driving TFT, as shown in FIG. 4, and the compensation voltage margin is secured at the data voltage Vdata corresponding to 0G, the swing width of the data voltage Vdata increases between 0G and a higher grayscale, resulting in pixel voltage drop increase. Accordingly, a voltage corresponding to the grayscale to be represented by the pixel voltage is not charged, causing pixel luminance deterioration. Therefore, when the voltage corresponding to 0G is set to 0V when the compensation voltage margin is secured, voltage drop in pixels increases in the halftone data block, causing luminance deterioration at low grayscales.

Figure 10:
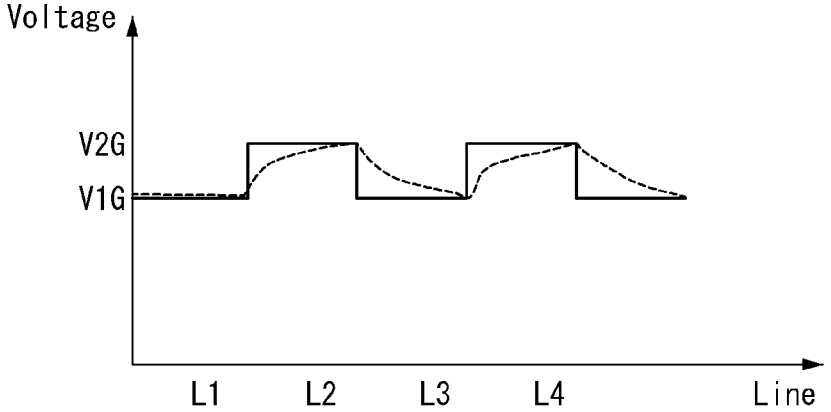
FIG. 10 is a graph showing a swing width of a data voltage when grayscale 0.5 as shown in FIG. 8 is expressed in an example in which the compensation voltage margin is secured and the data voltage corresponding to grayscale 0 is set to 0V.

FIG. 10 illustrates a data voltage swing width when grayscale 1.5 as shown in FIG. 8 is represented in an example in which a compensation voltage margin is secured and a data voltage corresponding to grayscale 0 is set to 0V. When the source voltage Vs of the driving TFT is increased by the reference voltage Vref in order to compensate for negative shift of the threshold voltage Vth of the driving TFT, as shown in FIG. 4, and the compensation voltage margin is secured at the data voltage Vdata corresponding to 0G, the swing width of the data voltage Vdata between 1G and a higher grayscale is less than that in FIG. 9. Consequently, pixel luminance deterioration does not occur since voltage drop in pixels is relatively small in a data block which does not include 0G. In FIGS. 9 and 10, solid lines represent the data voltage Vdata output from the data driver 12 and dashed lines represent pixel voltages charged in a pixel, which are decreased from the data voltage Vdata due to RC delay of the display panel 10.

Figure 11:
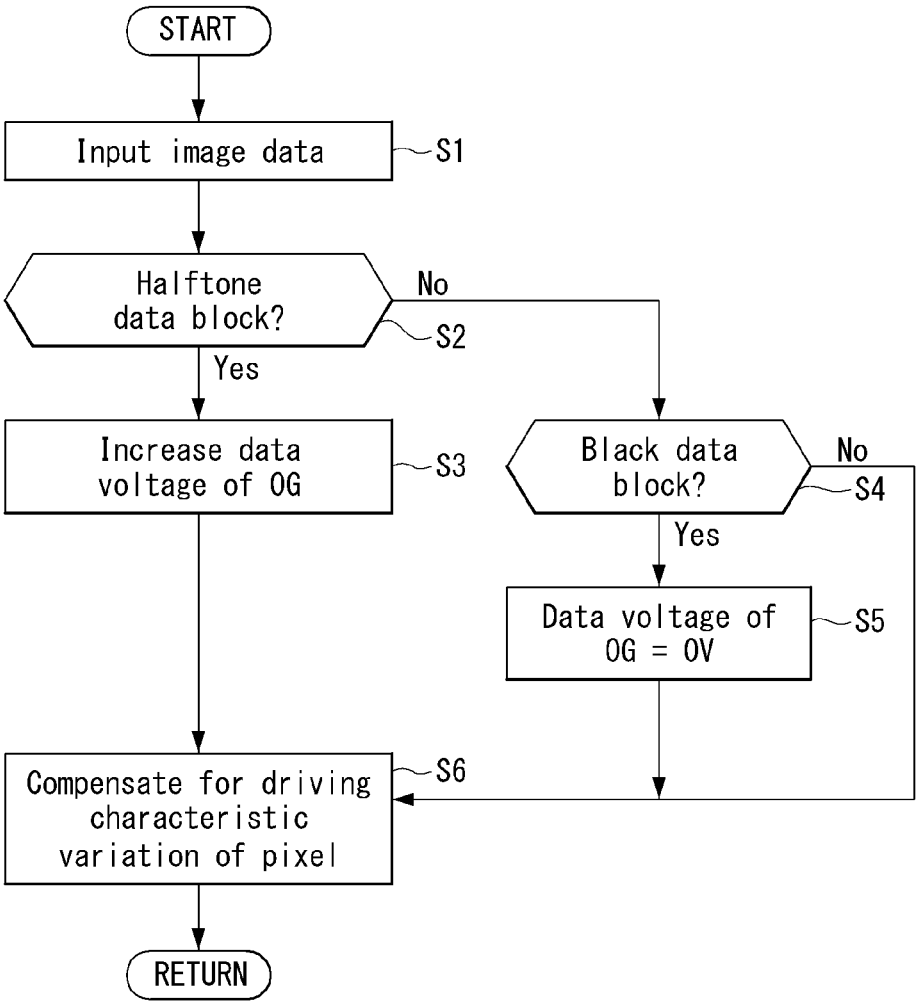
FIG. 11 is a flowchart illustrating a method for driving an organic light-emitting display device according to an embodiment of the present invention.

In the example in which the compensation voltage margin is secured and the data voltage of 0G is set to 0V, when the voltage corresponding to grayscale 0 is uniformly applied as 0V, charge of the data voltage in a pixel is largely varied according to presence or absence of 0G, causing luminance variation at low grayscales. To solve this problem, the present invention detects a halftone data block and a black data block by analyzing input image data in units of a window mask having a predetermined size and adjusts the voltage corresponding to 0G of the halftone mask block to higher than that of the black data block, as shown in FIGS. 11 and 12.

Luminance decrease in a low grayscale region including 0G can be solved by increasing the voltage corresponding to 0G so as to reduce a voltage drop width. When the voltage corresponding to 0G is set to as low as 0V, luminance of 0G can be controlled to be minimum luminance in all pixels and the compensation voltage margin for driving characteristic variations (change with time) of pixels, which occur as driving time elapses, can be secured. The minimum luminance is luminance of black grayscale having pixel luminance of 0 nit. When the voltage corresponding to 0G is simply adjusted to a voltage higher than 0V in all pixels, threshold voltage shift cannot be compensated when the threshold voltage Vth of the driving TFT DT is negatively shifted in part of the pixels and thus luminance of black grayscale of the corresponding pixels may be increased. The present invention analyzes an input image in units of a predetermined window mask and, when the grayscale (referred to as "center grayscale" hereinafter) of center data positioned at the center of data in the window mask is 0G, separately detects a halftone data block and a black data block in consideration of the number of grayscales higher than 0G in neighbor data.

The present invention increases the voltage corresponding to 0G of the center data in the halftone data block to higher than 0V by adding the first compensation value to the center data. The present invention maintains the voltage corresponding to 0G of the center data to 0V which is preset in the black data block. To increase data voltage swing width reduction effect when grayscales including 0G vary, it is desirable that the voltage corresponding to 0G be adjusted to a maximum voltage within a voltage range within which the driving TFT DT is maintained in an off state in the compensation voltage range corresponding to an increase in the source voltage of the driving TFT DT. However, the present invention is not limited thereto. The maximum voltage within the voltage range within which the driving TFT DT is maintained in an off state may be the reference voltage Vref or a voltage close to the reference voltage Vref. The voltage corresponding to G0 needs to be higher than 0V within the compensation voltage range and to be adjusted within the voltage range of 0V to Vref. This is because luminance of the minimum grayscale increases as the voltage corresponding to 0G increases to a voltage at which the driving TFT of a pixel is turned on such that the OLED emits light.

The present invention determines whether data of all pixels belongs to the halftone data block or black data block while shifting the window mask by one pixel in a specific direction. The present invention adaptively controls the voltage corresponding to 0G of each pixel on the basis of the determination result to reduce a data voltage switching width at low grayscales and to prevent pixel luminance deterioration at grayscales lower than 1, thereby improving low grayscale expression. Furthermore, the present invention can not only secure the voltage compensation margin that enables compensation for negative shift of the driving TFT but only prevent black grayscale luminance increase in all pixels.

FIG. 11 is a flowchart illustrating a method for driving the organic light-emitting display device according to an embodiment of the present invention and FIG. 12 illustrates an exemplary window defining a data block.

Referring to FIGS. 11 and 12, the organic light-emitting display device according to an embodiment of the present invention analyzes input image data in units of an m×n window mask (S1). While FIG. 12 shows a 5×9 window mask, the present invention is not limited thereto.

When the center grayscale D35 disposed at the center of the window mask is 0G and the number of grayscales higher than 0 in neighbor data D11 to D34 and D36 to 59 exceeds a predetermined threshold voltage T, the present invention determines a data block having the center grayscale as the center as a halftone data block. The present invention defines the block determination result as a logic value of a dithering black flag.

$$\text{Dithering black flag} = \begin{cases} 1, & \text{if (Center gray} = 0)(Cnt \geq T) \\ 0, & \text{otherwise} \end{cases}$$

Here, Center gray indicates the center grayscale D35 disposed at the center of the window mask, Cnt indicates the number of grayscales higher than 0 in the window mask, and T is the threshold value for determining a black data block. T can be experimentally determined as a value equal to or greater than 2. The present invention sets T to a value by which the low grayscale gamma curve 52 as shown in FIG. 5 approximates 2.2 gamma (51 shown in FIG. 5) on the basis of an experimental result obtained by measuring pixel luminance while varying T. As T decreases, the frequency of determination of a halftone data block increases and thus the number of pixels in which the voltage corresponding to 0G is raised increases. Since black grayscale luminance may increase in part of black grayscale pixels in which 0G is widely distributed as T decreases, T needs to be appropriately selected through experimentation. Accordingly, T needs to be selected in consideration of gamma improvement level and black grayscale luminance increase. When the size of the window mask changes, Cnt and T vary. Only when T increases in proportion to the window mask size, can gamma improvement of a desired level be obtained.

When a currently analyzed data block in the input image data is a halftone data block, the data voltage corresponding to 0G is increased to a voltage (V0G in FIG. 14) higher than 0V by adding the first compensation value to 0G data corresponding to the center grayscale D35 of the data block (S2 and S3). The voltage corresponding to 0G of the halftone data block is controlled with the range of 0V to Vref.

Figure 13:
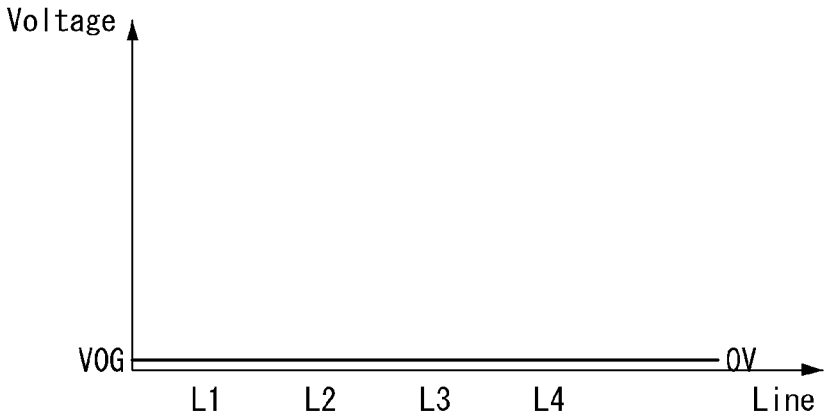
FIG. 13 illustrates a typical black data block.
Figure 15:
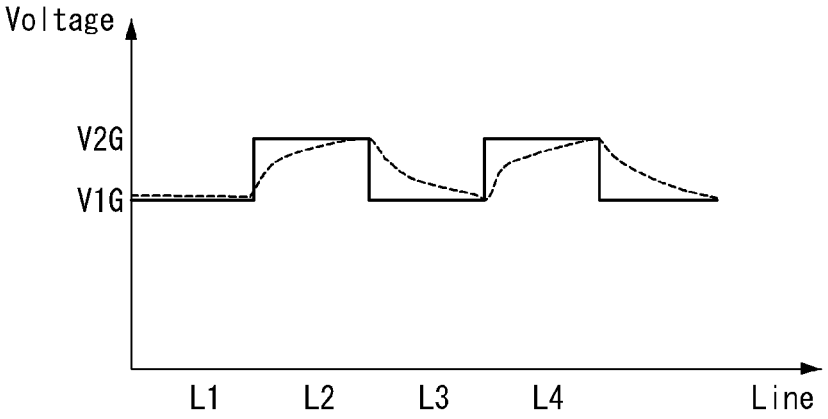
FIG. 15 illustrates an exemplary data block in a dither pattern for representing grayscale 1.5.

When the center grayscale D35 of the currently analyzed data block in the input image data is a grayscale higher than 0G, as shown in FIG. 15, or corresponds to a black data block, the present invention maintains the voltage of 0G as 0V at the center pixel of the data block. The black data block is a data block in which the center grayscale is 0 and the number of grayscales higher than 0 in neighbor data D11 to D34 and D36 to D59 is less than a predetermined threshold value T. Since most pixels in the black data block have 0G, the present invention adjusts the voltage of 0G to a minimum voltage, that is, 0V, as shown in FIG. 13, such that the driving TFT DT is not turned on in all pixels in the block (S4 and S5).

Figure 14:
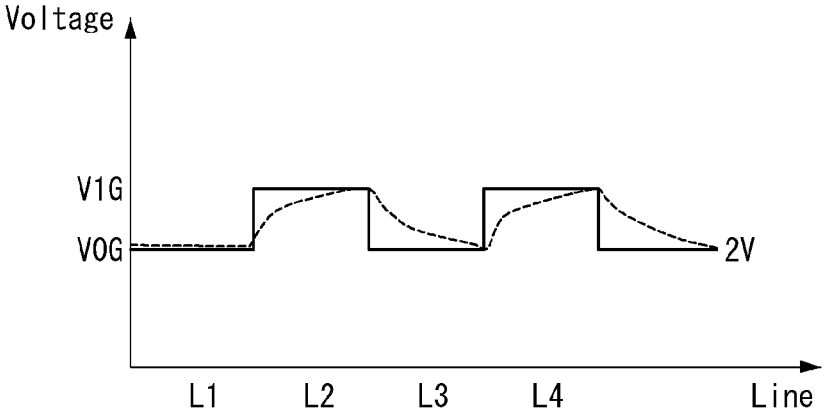
FIG. 14 illustrates an exemplary data block in a dither pattern for representing grayscale 0.5.

An exemplary halftone data block is a dither pattern representing grayscale 0.5, as shown in FIG. 14. In this dither pattern, compensation value "1" is distributed in a dither window mask and the number of pixels to which the compensation value is added is equal to the number of 0G pixels. In the case of the halftone data block, the present invention reduces a data voltage swing width so as to decrease voltage drop by increasing the voltage of 0G to a voltage at which the driving TFT DT can be controlled to be turned off within a predetermined compensation voltage range.

After adjusting the voltage V0G corresponding to 0G to a higher level in the halftone data block, the present invention compensates for driving characteristic variations in pixels by adding or multiplying a second compensation value set through an external compensation method to or by data (S6).

0G data modulated by the data modulation module is transmitted to the data driver 12. The modulated 0G data is obtained by adding the first compensation value to the data of 0G. The data driver 12 converts the modulated 0G data into a gamma compensation voltage so as to generate a data voltage V0G of 0G. The data voltage V0G of 0G is supplied to the gate of the driving TFT DT of each pixel through a data line.

FIG. 15 illustrates an exemplary data block of a dither pattern to represent grayscale 1.5. Since the center grayscale of the data block is not 0G, the voltage corresponding to 0G is maintained as 0V at the center grayscale of the data block.

In FIGS. 13, 14 and 15, L1 to L4 indicate horizontal line numbers of the pixel array of the display panel 10, V0G indicates the voltage of 0G, V1G represents the voltage of 1G and V2G represents the voltage of 2G. V0G is a voltage at which the driving TFT DT is maintained in an off state, that is, a voltage in the range of 0V to Vref. When V1G and V2G are applied to the gate of the driving TFT DT, the driving TFT DT is turned on and thus the OLED emits light with high luminance.

When the number of grayscales higher than 0, Cnt, in the halftone data block is half the number of data, (m×n), in the window mask, this can be expected as a case having the largest number of swings of the data voltage supplied through the data line. In this case, accordingly, data voltage swing width reduction effect can be maximized by maximizing voltage increase width of 0G. When Cnt is small in the halftone data block, it is necessary not to increase the voltage of 0G or to control the increase width to be narrow since most data of the halftone data block is black grayscale data having 0G. Considering this, an organic light-emitting display device according to another embodiment of the present invention varies the voltage of 0G according to Cnt in the halftone data block, as shown in FIG. 17C.

Figure 16:
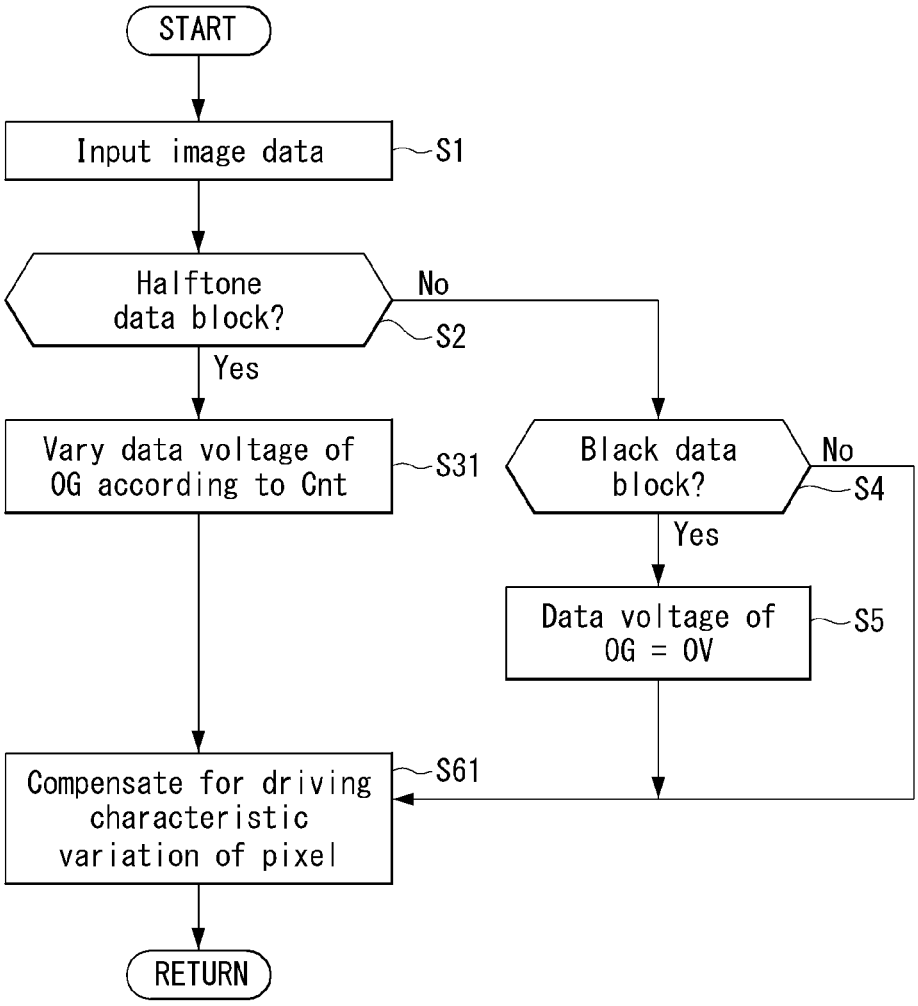
FIG. 16 is a flowchart illustrating a method for driving an organic light-emitting display device according to another embodiment of the present invention.
Figure 17A:
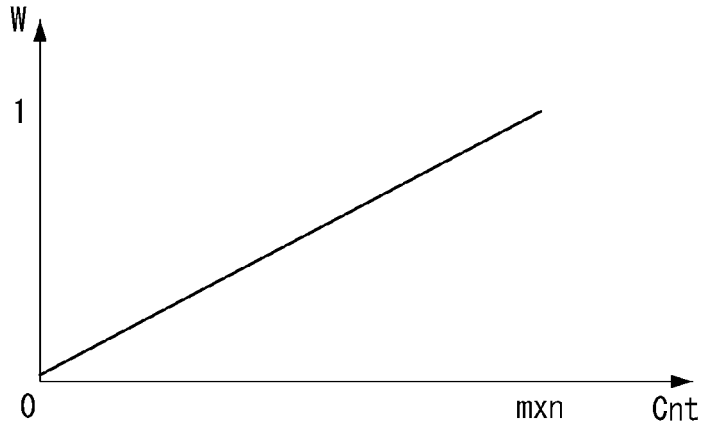
FIGS. 17A, 17B and 17C are graphs showing examples of varying a weight according to the number of grayscales higher than 0 in a halftone data block.
Figure 17B:
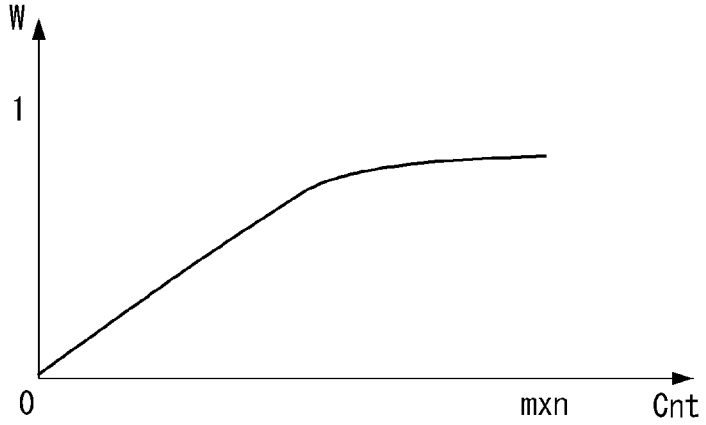
Figure 17C:
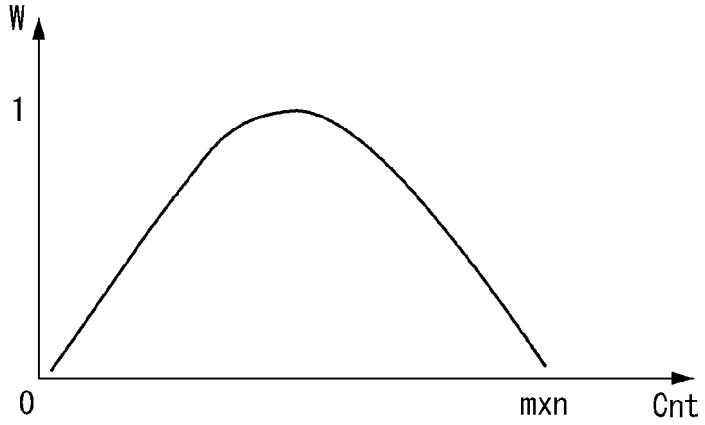

FIG. 16 is a flowchart illustrating a method for driving the organic light-emitting display device according to another embodiment of the present invention and FIGS. 17A, 17B and 17C illustrate examples of varying a weight according to the number of grayscales higher than 0 in a halftone data block.

Referring to FIGS. 16 to 17C, the organic light-emitting display device according to the present invention analyzes input image data in unit of an m×n window mask (Si).

When the center grayscale D35 disposed at the center of the window mask is 0G and the number of grayscales higher than 0, Cnt, in neighbor data D11 to D34 and D36 to 59 exceeds a predetermined threshold value T, the present invention determines a data block having the center grayscale as the center as a halftone data block.

When a currently analyzed data block in the input image data is a halftone data block, the first compensation value is added to the data of 0G corresponding to the center grayscale of the data block so as to increase the data voltage of 0G to a voltage higher than 0V (S2 and S31). Here, data voltage increase width of 0G varies according to a weight W determined by Cnt, as shown in FIGS. 17A, 17B and 17C. The weight W is multiplied by the first compensation value. Accordingly, the first compensation value varies the increase width of the voltage V0G of 0G according to Cnt.

The weight W may be varied in a monotone increasing form according to Cnt, as shown in FIGS. 17A and 17C. In this case, the voltage V0G of 0G gradually increases in proportion to Cnt. The weight W may increase in proportion to Cnt until Cnt reaches the intermediate value (m×n)/2 to arrive at the peak at the intermediate value (m×n)/2 of Cnt and gradually decrease as Cnt increases from the intermediate value (m×n)/2, as shown in FIG. 17C. In this case, the voltage V0G of 0G reaches the peak when Cnt corresponds to the intermediate value (m×n)/2. V0G needs to be adjusted in a voltage range in which the driving TFT is not turned on, for example, in the range of 0V to Vref, within the compensation voltage margin.

When the center grayscale D35 of the currently analyzed data block in the input image data is not 0G or the currently analyzed data block is a black data block, the present invention maintains the voltage of 0G as 0V at the center pixel of the data block (S4 and S5).

After adjusting the voltage of 0G V0G to a higher level in the halftone data block, the present invention compensates for driving characteristic variations in pixels by adding or multiplying the second compensation value set through an external compensation method to or by data (S61).

For reference, it is possible to confirm whether the present invention is applied to actual products through various methods. For example, it is possible to confirm application of the present invention by inputting a black image in which all pixel data is black grayscale data to the organic light-emitting display device, measuring a data voltage when the black image is input and measuring a data voltage of grayscale 0 when a dither pattern having grayscales lower than 1 or an image including a halftone data block is input to the organic light-emitting display device.

As described above, the present invention prevents black grayscale luminance increase in all pixels and reduces a data voltage swing width at grayscales lower than 1 by adjusting the voltage of 0G to a voltage higher than 0V in a halftone data block such as a dither pattern and adjusting the voltage of 0G to 0V in other data blocks, thereby preventing pixel voltage drop. As a result, the present invention can improve grayscale expression so as to enhance picture quality. Furthermore, the present invention can secure a compensation voltage margin capable of coping with negative shift of a threshold voltage of a driving element.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light-emitting display device including a plurality of pixels each having a driving element for controlling current of an organic light-emitting diode (OLED) according to a gate-source voltage of the driving element, comprising:

a data modulation module that analyzes input image data in units of a window mask to detect a halftone data block, adjusts a voltage corresponding to grayscale 0 of center data disposed at a center of the halftone data block to a voltage higher than 0V, and adjusts the voltage corresponding to grayscale 0 in a data block other than the halftone data block to 0V, wherein the halftone data block is a data block in which center data of the window mask has grayscale 0 and a number of grayscales higher than 0 exceeds a predetermined threshold value in neighbor data of the center data, wherein a reference voltage higher than 0V is supplied to a source of the driving element, and the voltage corresponding to grayscale 0 is supplied to a gate of the driving element.

2. The organic light-emitting display device of claim 1, wherein the voltage corresponding to grayscale 0 in the halftone data block is adjusted to a higher level within a voltage range in which the driving element is controlled to be turned off.

3. The organic light-emitting display device of claim 1, wherein the voltage corresponding to grayscale 0 in the halftone data block is selected within a voltage range from 0V to the reference voltage.

4. The organic light-emitting display device of claim 1, wherein the data block other than the halftone data block is a data block in which the number of grayscales higher than 0 in neighbor data of center data of the window mask is less than the threshold value when the grayscale of the center data of the window mask is 0 or higher than 0.

5. The organic light-emitting display device of claim 1, wherein the data modulation module comprises a first data compensation unit that adjusts the voltage corresponding to grayscale 0 to a higher level by adding a first compensation value to data corresponding to grayscale 0.

6. The organic light-emitting display device of claim 4, wherein the data block other than the halftone data block includes a data block in a dither pattern representing decimal grayscales less than 1.

7. The organic light-emitting display device of claim 5, wherein the first compensation value varies with the number of higher grayscales in the halftone data block.

8. The organic light-emitting display device of claim 5, wherein the voltage corresponding to grayscale 0 increases in proportion to the number of higher grayscales in the halftone data block.

9. The organic light-emitting display device of claim 5, wherein the voltage corresponding to grayscale 0 is highest when the number of higher grayscales in the halftone data block is half the number of pieces of data in the window mask.

10. The organic light-emitting display device of claim 1, further comprising a data driver for outputting a data voltage in a range increased by the reference voltage.

11. A method for driving an organic light-emitting display device including a plurality of pixels each having a driving element for controlling current of an organic light-emitting diode (OLED) according to a gate-source voltage of the driving element, the method comprising:

analyzing input image data in units of a window mask to detect a halftone data block;

adjusting a voltage corresponding to grayscale 0 of center data disposed at a center of the halftone data block to a voltage higher than 0V; and adjusting the voltage corresponding to grayscale 0 in a data block other than the halftone data block to 0V, wherein the halftone data block is a data block in which center data of the window mask has grayscale 0 and a number of grayscales higher than 0 exceeds a predetermined threshold value in neighbor data of the center data, wherein a reference voltage higher than 0V is supplied to a source of the driving element, and the voltage corresponding to grayscale 0 is supplied to a gate of the driving element.

12. The method of claim 11, wherein the adjusting the voltage corresponding to grayscale 0 in the halftone data block includes adjusting the voltage to a higher level within a voltage range in which the driving element is controlled to be turned off.

13. The method of claim 11, wherein the adjusting the voltage corresponding to grayscale 0 in the halftone data block includes selecting a voltage within a range from 0V to the reference voltage.

14. The method of claim 11, wherein the adjusting the voltage corresponding to grayscale 0 to a voltage higher than 0V includes adding a first compensation value to data corresponding to grayscale 0.

15. The method of claim 14, wherein the first compensation value varies with the number of higher grayscales in the halftone data block.

16. The method of claim 15, wherein the voltage corresponding to grayscale 0 increases in proportion to the number of higher grayscales in the halftone data block.

17. The method of claim 15, wherein the voltage corresponding to grayscale 0 is highest when the number of higher grayscales in the halftone data block is half the number of pieces of data in the window mask.

18. The method of claim 11, wherein the data block other than the halftone data block includes a data block in a dither pattern representing decimal grayscales less than 1.

19. The method of claim 11 further comprising outputting a data voltage in a range increased by the reference voltage.

* * * * *